US008887636B2

(12) United States Patent
De Vroome

(10) Patent No.: US 8,887,636 B2
(45) Date of Patent: Nov. 18, 2014

(54) PRINTING MATERIAL WEB PROCESSING MACHINE

(75) Inventor: Clemens Johannes Maria De Vroome, BB Beugen (NL)

(73) Assignee: Goss Contiweb B.V., Boxmeer (NL)

( * ) Notice: Subject to any disclaimer, the term of this patent is extended or adjusted under 35 U.S.C. 154(b) by 802 days.

(21) Appl. No.: 10/781,113

(22) Filed: Feb. 18, 2004

(65) Prior Publication Data

US 2004/0177780 A1 Sep. 16, 2004

(30) Foreign Application Priority Data

Mar. 14, 2003 (DE) ..... 103 11 234

(51) Int. Cl.

| | |
|---|---|
| ***B65H 23/00*** | (2006.01) |
| ***B41F 23/04*** | (2006.01) |
| ***B65H 23/188*** | (2006.01) |
| ***B41F 13/02*** | (2006.01) |

(52) U.S. Cl.

CPC ..... *B41F 23/0403* (2013.01); *B65H 2301/517* (2013.01); *B65H 2404/5521* (2013.01); *B65H 23/1888* (2013.01); *B65H 2513/11* (2013.01); *B41F 13/02* (2013.01); *Y10S 101/42* (2013.01)

USPC ..... 101/484; 101/488; 101/DIG. 42; 226/178; 226/195; 242/615.2

(58) Field of Classification Search

USPC ..... 101/424.1, 484, 488, DIG. 42; 226/178, 226/195; 242/615, 615.2

See application file for complete search history.

(56) References Cited

U.S. PATENT DOCUMENTS

| | | | | | |
|---|---|---|---|---|---|
| 1,594,395 | A | * | 8/1926 | Weston | 226/40 |
| 1,972,902 | A | * | 9/1934 | Potdevin | 226/114 |
| 3,220,347 | A | * | 11/1965 | Luehrs | 101/179 |
| 3,238,869 | A | * | 3/1966 | West et al. | 101/228 |
| 3,539,085 | A | * | 11/1970 | Cline et al. | 226/25 |
| 3,743,154 | A | * | 7/1973 | Brewitz | 226/113 |
| 3,875,682 | A | * | 4/1975 | Justus et al. | 34/118 |
| 4,508,033 | A | * | 4/1985 | Fischer | 101/217 |
| 4,767,042 | A | * | 8/1988 | Daane | 242/615.11 |
| 4,833,794 | A | * | 5/1989 | Stibbe et al. | 34/643 |
| 5,105,562 | A | * | 4/1992 | Hella et al. | 34/643 |
| 5,156,312 | A | * | 10/1992 | Kurie | 242/615.11 |
| 5,184,555 | A | * | 2/1993 | Quadracci et al. | 101/417 |

(Continued)

FOREIGN PATENT DOCUMENTS

| | | |
|---|---|---|
| DE | 104 753 | 3/1974 |
| DE | 199 52 917 C1 | 6/2001 |

(Continued)

*Primary Examiner* — Jill Culler

(74) *Attorney, Agent, or Firm* — Davidson, Davidson & Kappel, LLC

(57) ABSTRACT

A printing material web processing machine, in particular a web-fed rotary offset press, has at least one press cylinder for printing the web, a dryer disposed downstream of the press cylinder, which guides the web along a path, and at least a first pull roll disposed downstream of the dryer to convey the web along the path with a given tensile stress. The web processing machine further has a first apparatus disposed downstream of the press cylinder and upstream of the dryer for separating the web from the press cylinder, and a second apparatus for driving the first pull roll, which drives the first pull roll at a rotational speed that is reduced as compared with the rotational speed of the press cylinder.

24 Claims, 2 Drawing Sheets

(56) References Cited

U.S. PATENT DOCUMENTS

| | | | | |
|---|---|---|---|---|
| 5,913,471 | A * | 6/1999 | Makosch et al. | 226/186 |
| 6,058,844 | A | 5/2000 | Niemiec | |
| 6,298,782 | B1 * | 10/2001 | Gregory et al. | 101/484 |
| 6,550,390 | B2 | 4/2003 | Frankenberger | |
| 6,832,831 | B2 * | 12/2004 | Shima et al. | 347/102 |

FOREIGN PATENT DOCUMENTS

| | | | |
|---|---|---|---|
| DE | 100 28 667 | A1 | 12/2001 |
| JP | 06071858 | A | 3/1994 |
| JP | 06122188 | A | 5/1994 |

* cited by examiner

PRINTING MATERIAL WEB PROCESSING MACHINE

BACKGROUND OF THE INVENTION

Field of the Invention

The present invention relates to a printing material web processing machine having at least one press cylinder for printing a web, a dryer disposed downstream of the press cylinder, for guiding the web along a path, and a pull roll disposed downstream of the dryer for conveying the web along the path with a given tensile stress.

Furthermore, the present invention relates to a method of treating a printing material web in a printing material web processing machine. The method has the steps of feeding a web to a press cylinder under a first tensile stress, printing on the web using the press cylinder, and conveying the web along a drying path.

Machines and methods of this type are used, inter alia, in the graphics industry, in particular in web-fed rotary offset printing and in the processing or treatment of paper webs and printed products.

In web-fed rotary offset presses, a paper web is usually unwound from a supply roll and guided through a number of printing units, which print the web, normally on both sides and in many colors, in a wet offset process. In order to dry the web and fresh printing ink, the web is usually guided through a hot air dryer, in which water and a volatile solvent from the printing evaporate. The web is then guided over cooling rolls of a cooling roll stand, which is flushed through by a cooling medium, in order to cool the web and to harden the liquid ink. Finally, in order to produce the finished printed products, the web is guided to a folder, which can fold and cut the web in various configurations. The finished products are then often supplied to a dispatch room.

In the following text, the term "fluting" is used and should therefore be explained at this point. This term stands for an effect that is observed during the drying of printed material webs. The web guided through a dryer under tensile stress, that is to say a longitudinal web stress, forms waves, peaks and valleys of the waves extending in the web transport direction and corrugation of the web transverse to the transport direction being produced. During the drying of the web, these waves are fixed in the web, as a result of which the printed products are disadvantageously affected. The waves that have been produced by the fluting can disadvantageously be detected in the finished printed product, that is to say are visible.

Furthermore, in the following text, the term "meander-like" is used and should therefore be explained at this point. A material web has a meander-like path, for example, when the path is at least partly composed of oppositely curved sections. The web path can, for example, also be designated curvy, wavy, looped, S-shaped, serpentine or tortuous. The web path can also be substantially sinusoidal.

Japanese Patent Application JP 06-71858 A discloses a machine as described above. The machine for processing a printing material web is described and shown in FIG. 1. The machine contains a press cylinder, a dryer and cooling rolls. A printing material web is printed by the press cylinder, guided along a drying path in the dryer and cooled by the cooling rolls.

In order to prevent fluting in horizontal sections along the processing path, it is proposed to guide the web along a meander-like drying path and along a meander-like path from the dryer to the cooling rolls. In order to produce the meander-like path in the dryer, the latter has blower nozzles, which are disposed on opposite sides of the web and spaced apart from one another in the horizontal direction. The nozzles also have a curved guide surface for the web, the guide surface of nozzles lying opposite each other with respect to the web plane being disposed to be offset in relation to one another in the vertical direction in such a way that the web is forced on a meander-like path.

Between the dryer and the cooling rolls, the use of further curved guide surfaces is proposed, which likewise force the web on a meander-like path.

However, the proposed machine has the problem that the web is guided along the path formed like a meander and provided with guide surfaces, so that, first, disruptive contact between the web and the surfaces can occur and, second, threading the web into the meander-like path is made more difficult, since horizontal, rectilinear guidance of the web is not possible.

Furthermore, U.S. Pat. No. 6,058,844 discloses a machine and a method for processing a printing material web, the intention being to keep fluting at a minimum.

It is proposed, and shown in FIG. 1, to guide a web from a last printing unit through a float dryer and over cooling rolls under a tensile stress produced by a unit disposed downstream, for example by a folder. Under the influence of the tensile stress, fluting waves can form in the dryer, which are intended to be minimized by the proposed use of cambered cooling rolls or curved spreader rolls.

However, the proposed solution has the problem that fluting waves are not intended to be prevented but minimized again after their production in the dryer, and that cambered cooling rolls or cooling rolls in conjunction with curved spreader rolls are considerably more expensive than conventional cooling rolls. Furthermore, the web is disadvantageously broadened in both cases.

It is also known from Published, Non-Prosecuted German Patent Application DE 100 28 667 A1, corresponding to U.S. Pat. No. 6,550,390, and shown in FIG. 1 there, in order to separate a printing material adhering with its printed side from a cylinder in a printing material processing machine, to align the waves with a pocket-like space between the printing material and the cylinder.

Furthermore, it is known from East German Patent No. DD-C 104 753 and shown there in FIG. 3 to blow compressed air between the blanket cylinder and the sheet in the pocket-like space between a blanket cylinder and a press cylinder on the side of the printed sheet running out, in the region of the pull-off angle $\alpha$, in order to prevent the printed side of the sheet adhering to the blanket cylinder.

SUMMARY OF THE INVENTION

It is accordingly an object of the invention to provide a printing material web processing machine that overcomes the above-mentioned disadvantages of the prior art devices and methods of this general type, which makes it possible to process a printing material web in such a way that printed products are produced without or with minimal fluting.

A printing material web processing machine according to the invention, in particular a web-fed rotary offset press, has at least one press cylinder for printing the web, a dryer disposed downstream of the press cylinder, which guides the web along a path, and at least a first pull roll disposed downstream of the dryer in order to convey the web along the path with a tensile stress. The invention is distinguished by the addition of an apparatus disposed downstream of the press cylinder and upstream of the dryer for separating the web from the press cylinder, and an apparatus for driving the first pull roll, which drives the first pull roll at a rotational speed that is reduced as compared with the rotational speed of the press cylinder.

The solution according to the invention has the advantage that the production of fluting waves is prevented or at least minimized.

The terms "disposed downstream" and "disposed upstream" are to be understood in this application in such a way that the unit disposed downstream or upstream in relation to a reference unit can be disposed downstream or upstream both directly and indirectly, that is to say downstream or upstream of at least one intermediate unit.

According to the invention, the printing material web is separated by the apparatus disposed downstream of the press cylinder and upstream of the dryer in order to separate the web from the press cylinder and is conveyed along the path with a tensile stress by the first pull roll, which is disposed downstream of the dryer and which is driven at a rotational speed that is reduced as compared with the rotational speed of the press cylinder.

The rotational speed of the first pull roll is reduced as compared with the rotational speed of the press cylinder, so that the tensile stress is reduced, at least in the region of the dryer, as compared with the tensile stress that is produced by the press cylinder, at least in the region upstream of the press cylinder.

According to the invention, the first pull roll can advantageously be driven at a rotational speed that is reduced as compared with the rotational speed of the press cylinder, since the pull roll merely needs to produce a tensile stress for conveying the already separated web downstream of the printing cylinder but not for separating the web from the press cylinder.

The separation operation or the apparatus for separating the web from the press cylinder is/are advantageously decoupled from the following conveying operation or the apparatus for conveying the web.

According to the invention, the rotational speed of the first pull roll is reduced as compared with the rotational speed of the press cylinder. The tensile stress prevailing in the region or in the section of the dryer can consequently advantageously be kept low, for example less than about 50 N/m, in such a way that the curves of a meander-like web path which are formed can have a large curvature or a small radius of curvature, for example less than about 200 mm.

It has surprisingly been found that fluting can advantageously be prevented or at least considerably reduced or minimized by the web being guided under a low web tension and along a meander-like web path with a small radii of curvature, in particular along a drying path.

An advantageous development of the printing material web processing machine according to the invention is distinguished by the fact that the apparatus for driving the first pull roll contains an apparatus for setting, controlling or regulating the rotational speeds of the first pull roll and of the press cylinder, which sets, controls or regulates the rotational speed of the first pull roll to a value below the value of the rotational speed of the press cylinder.

A further advantageous development of the printing material web processing machine according to the invention is distinguished by the fact that the apparatus for separating the web from the press cylinder is configured to separate the web from the press cylinder without contact, in particular has at least one blowing element or at least one ultrasound element.

However, it is also possible, in order to release the web without a separating apparatus, to provide the press cylinder, for example a blanket cylinder, with a rubber blanket or a blanket sleeve from which the printing ink separates substantially completely and is transferred to the web, that is to say substantially no ink splitting takes place and the web is released even under very low tensile stress.

A printing material web processing machine according to the invention, in particular a web-fed rotary offset press, has at least one press cylinder printing the web, a dryer disposed downstream of the press cylinder, which guides the web along a path, and at least a first pull roll disposed downstream of the dryer in order to convey the web along the path with a tensile stress. The invention is distinguished by a second pull roll disposed downstream of the press cylinder and upstream of the dryer and releasing the web, and an apparatus for driving the first pull roll, which drives the first pull roll at a rotational speed that is reduced as compared with the rotational speed of the second pull roll.

This machine according to the invention incorporates advantages as have been described above in relation to a machine according to the invention.

The term "releasing" is to be understood in such a way that the pull roll can release the web both automatically and with the use of a separating apparatus.

Instead of a separating apparatus, use is made of a second pull roll, which separates the web from the press cylinder and which releases the web even under a low or extremely low web tension. The pull roll can interact with an opposing roll, for example be set against the latter.

An advantageous development of the printing material web processing machine according to the invention is distinguished by the fact that the apparatus for driving the first pull roll contains an apparatus for setting, controlling or regulating the rotational speed of the first and the second pull roll, which sets, controls or regulates the rotational speed of the first pull roll to a value below the value of the rotational speed of the second pull roll.

A further advantageous development of the printing material web processing machine according to the invention is distinguished by the fact that the second pull roll or the apparatus for separating the web from the press cylinder is configured or coated in an ink-repellent manner, at least in some sections.

In this way, it is advantageously possible to prevent color being deposited or built up. An ink-repellent second pull roll releases the web and has no disruptive influence on the printed image.

Ink-repellent materials are known, for example as those with oleophobic surface properties.

A further advantageous development of the printing material web processing machine according to the invention is distinguished by the fact that the first pull roll is constructed as a cooling roll.

A further advantageous development of the printing material web processing machine according to the invention is distinguished by the fact that the first and the second pull roll are in each case constructed as a driven, in particular separately driven, rotating element; or that the first pull roll and the press cylinder are in each case constructed as a driven, in particular separately driven, rotating element.

In each case, an electric motor can be provided for the separate drive.

A method according to the invention for treating a printing material web in a printing material web processing machine, in particular in a web-fed rotary offset press, includes feeding a web fed to a press cylinder under a first tensile stress. The web is printed by the press cylinder, and the web is conveyed along a drying path. The method is distinguished by the fact that the web is separated from the press cylinder, and that a second tensile stress of the web, which is reduced as compared with the first tensile stress, is set along the drying path.

The method according to the invention incorporates advantages as have been described above in relation to the machines according to the invention.

A web treated or processed in accordance with the method according to the invention can form a meander-like web path with a small radii of curvature, for example less than about 200 mm, along the drying path with a reduced or low tensile stress, for example less than about 50 N/m. A web treated in this way advantageously has no or at least reduced or minimal fluting defects.

An advantageous development of the method according to the invention is distinguished by the fact that the second tensile stress is set, controlled or regulated to a value, in particular a substantially minimal value, which is suitable for conveying the web separated from the press cylinder.

A further advantageous development of the method according to the invention is distinguished by the fact that the web is conveyed along a drying path composed of part paths that follow one another and are oppositely curved.

A further advantageous development of the method according to the invention is distinguished by the fact that the tensile stress is controlled or regulated in such a way that the drying path is composed of part paths that follow one another and are oppositely curved.

A further advantageous development of the method according to the invention is distinguished by the fact that the tensile stress is controlled or regulated in such a way that the drying path is substantially meander-like, in particular substantially sinusoidal.

A further advantageous development of the method according to the invention is distinguished by the fact that the tensile stress is controlled or regulated to a value less than substantially 50 N/m.

A further advantageous development of the method according to the invention is distinguished by the fact that the tensile stress is controlled or regulated in such a way that the drying path has radii of curvature following one another of in each case less than substantially 200 mm.

A further advantageous development of the method according to the invention is distinguished by the fact that the temperature of the web is increased along the drying path.

It has been shown that a slow temperature rise of the web along the drying path with a low tensile stress has an advantageous effect on preventing or reducing fluting.

Other features which are considered as characteristic for the invention are set forth in the appended claims.

Although the invention is illustrated and described herein as embodied in a printing material web processing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
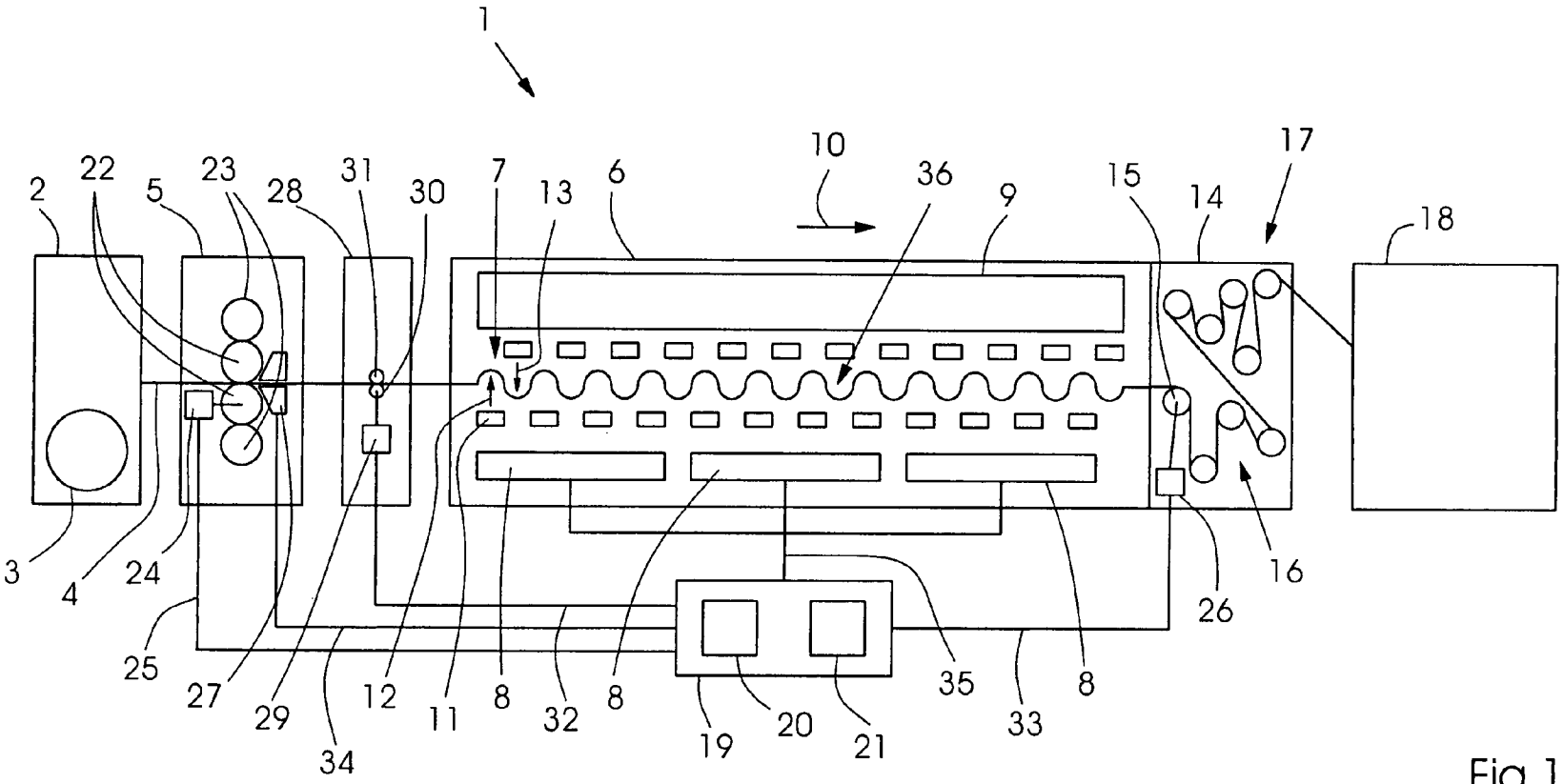
FIG. 1 is a diagrammatic, sectional view of a machine according to the invention.

Referring now to the figures of the drawing in detail and first, particularly, to FIG. 1 thereof, there is shown a diagrammatic, sectional view of a machine 1 according to the invention, in this case a web-fed rotary offset press.

The machine 1 contains a roll changer 2 with a supply roll 3 of a printing material web 4, preferably a paper web. The web 4 is unwound in the roll changer 2 and, toward the end of unwinding the roll 3, can be joined to a new web, on-the-fly or at a standstill.

The web 4 is fed to a series of printing units, only one printing unit 5 being illustrated in FIG. 1 for reasons of clarity. The printing unit 5, in the case of a plurality of printing units following one another, is to be understood as the last of the printing units, that is to say printing unit 5 prints ink onto the web 4 last.

The printed web 4 is fed to a dryer 6, preferably a hot air float dryer, in which the web 4 is guided floating along a drying path 7 and is acted on with heated air. For this purpose, the dryer contains blower units 8, which suck in air heated by a heating unit 9, preferably a burner, and feeds it to nozzle bars 11 which extend transversely with respect to a web transport direction 10, from which the air is blown onto both sides of the web 4 (see exemplary arrows 12 and 13 for the blowing direction). Air guide units that may be present between the heating unit, the blower units and the nozzle bars are not illustrated for reasons of clarity.

Disposed downstream of the dryer 6 is a cooling unit 14, preferably a cooling roll stand. The cooling unit 14 is preferably disposed directly downstream of the dryer 6 or forms a unit with the dryer 6, so that the web 4 is fed from the dryer to a first cooling roll 15 of the cooling unit 14 directly and on a short path.

The web 4 is guided along a cooling path 16 around a large number of cooling rolls 17, around which the web wraps for the purpose of heat transfer. In order to dissipate the transferred thermal energy of the web 4, a cooling medium, in this case water, flushes through the cooling rolls 17.

The web 4 is then fed to a further processing unit 18, in this case a folder 18. The folder 18 can contain a turner bar superstructure and a product delivery and conveying system.

The machine 1 also has a unit 19 for setting, controlling or regulating the processing of the web 4, referred to as a control unit below. The control unit 19 preferably contains a computing unit 20 and a memory unit 21. The control unit 19 can also be connected to a non-illustrated input unit, for example a keyboard, a mouse or a touch screen.

The treatment operation or the processing operation of the web 4 in the machine 1 will be described below.

The unwound web 4 is fed to the printing unit 5 or a last printing unit 5 of a series of printing units under tensile stress, that is to say a longitudinal web stress. The tensile stress in a section upstream of the printing unit 5 is produced by the press cylinders or transfer cylinders 22 rotating and set against one another. In this case, one of the press cylinders, for example a transfer cylinder 22 or a form cylinder 23, is preferably driven by a motor 24. A drive rotational speed of the motor 24 and thus the rotational speed of the transfer cylinder 22 is predefined, set, controlled or regulated by the control unit 19. For this purpose, the control unit 19 is connected to the motor 24 via a line 25, preferably a data or signal line.

Increasing the rotational speed of the transfer cylinder 22 as compared with a rotational speed of an upstream transfer cylinder of a non-illustrated upstream printing unit or an upstream non-illustrated pull roll of the roll changer 2 has the effect of increasing the tensile stress in the section between transfer cylinder 22 and the upstream transfer cylinder or the upstream pull roll. The tensile stress can thus be influenced via the rotational speed or the rotational speed ratio.

The web 4 is, furthermore, conveyed from the printing unit 5 through the dryer 6 to the cooling unit 14 under a tensile stress, the tensile stress preferably being produced or built up by a driven cooling roll 15. Alternatively, a pull roll disposed downstream of the dryer 6 and disposed upstream or downstream of the cooling unit or integrated in the cooling unit can be provided, which affects the tensile stress.

The driven cooling roll is preferably the first cooling roll 15 of the cooling unit. Alternatively, any other cooling roll 17 can also be configured to produce a tensile stress. The drive provided is a motor 26, whose drive rotational speed determines the rotational speed of the cooling roll and is predefined, set, controlled or regulated by the control unit 19 via a line 33.

Reducing the rotational speed of the driven cooling roll 15 as compared with the driven transfer cylinder 22 effects a reduction in the tensile stress in the section or region between transfer cylinder 22 and cooling roll 15, in particular in the region of the dryer 6 or the drying path 7.

Given appropriately selected rotational speed relationships, the tensile stress along the drying path 7 can be lower than the tensile stress upstream of the printing unit 5 (in a printing path). In particular, the tensile stress along the drying path 7 can be considerably lower than a conventional tensile stress in a printing path, for example in the region of about 10%.

The web 4 is acted on with printing ink and moisture (possibly on both sides) from the transfer cylinder or cylinders 22, the web 4 tending to remain adhering to the rotating surface of the transfer cylinder 22 because of the fresh printing ink and its adhesive capacity (tack value). In order to separate the web 4 from the transfer cylinders 22, use can be made of an apparatus 27 for separating the web 4 from the press cylinder or transfer cylinder 22, the separating apparatus in the following text, and/or a pulling unit 28.

Alternatively, the surface of the transfer cylinder 22 can be formed as a substantially completely ink-transferring surface, for example as a surface with a low polar surface energy.

Use is preferably made of only one separating apparatus 27. This effects separation of the web 4 from the press cylinder 22, for example by using blown air and/or ultrasound in the pocket between the web 4 and the cylinder 22. Blown air and ultrasound act as doctors and assist the ink splitting. Furthermore, a laser aimed into the pocket and possibly scanning horizontally can also be used for separating the web.

Alternatively, it is possible for the pulling unit 28 to be used additionally or on its own. This assists or effects the separation of the web 4 from the press cylinder 22 by a suitable tensile stress. The tensile stress can be produced or built up by a pull roll 30 driven by a motor 29. The pull roll can interact with an opposing roll 31 and its surface can have an ink-repellent property, so that adhesion of the freshly printed web 4 to the pull roll 20 does not occur and so that the web 4 is released by the pull roll 30 even with a very low tensile stress as compared with conventional tensile stresses between printing units, for example in the range of about 10% or less.

The control unit 19 is connected via lines 32 and 33 to the drive motors 29 and 26 in order to predefine, set, control or regulate the respective rotational speeds. Furthermore, the control unit 19 can be connected via a line 34 to the separating units 27 and, for example, predefine, set, control or regulate the quantity or intensity of blown air or the irradiation intensity of the ultrasound source or laser source. Furthermore, the control unit 19 can be connected via a line 35 to components of the dryer in order, for example, to predefine, set, to control or to regulate the blown air intensity of the nozzle bars 11.

The driven units contains the press cylinder 22, the pull roll 30 and/or cooling roll 15 can be provided with transmitters or sensors which are connected to the control unit 19 to transfer actual values of the rotational speeds for a control process. Alternatively, the transmitters can also be disposed on the motors 24, 29 and/or 26.

Furthermore, a sensor, for example a distance sensor for determining the vertical web position, can be disposed in the region of the press nip between the transfer cylinders 22, which sensor monitors the desired separation operation of the web 4 and is connected to the control unit 19 in order to transfer an actual value, for example the web position, for a control process.

Furthermore, a sensor, for example a distance sensor for determining the vertical web position, can also be disposed in the region of the drying path, which sensor monitors the desired drying path of the web 4 and is connected to the control unit 19 in order to transfer an actual value, for example the web position or the deflection of a turn of the web, for a control process.

The use according to the invention of the separating apparatus 27 in combination with an apparatus for driving the cooling roll 15, which can be designated a first pull roll disposed downstream of the dryer, the apparatus driving the cooling roll at a rotational speed that is reduced as compared with the rotational speed of the press cylinder 22, permits the tensile stress in the region of the drying path 7 to be reduced to such an extent that the web 4 can follow a meander-like path 36 in the range of influence of the nozzle bars 11. The reduced tensile stress in conjunction with the meander-like path 36 advantageously prevents the production of fluting waves in the web 4.

Furthermore, the use according to the invention of an apparatus for driving the cooling roll 15, which can be designated a first pull roll disposed downstream of the dryer, in combination with a second pull roll 30 which is disposed downstream of the press cylinder 22 and upstream of the dryer 6 and releasing the web, the apparatus driving the cooling roll at a rotational speed that is reduced as compared with the rotational speed of the second pull roll 30, also permits the tensile stress in the region of the drying path 7 to be reduced to such an extent that the web 4 can follow a meander-like path 36 in the range of influence of the nozzle bars 11. The reduced tensile stress in conjunction with the meander-like path 36 advantageously prevents the production of fluting waves in the web 4.

The web 4 processed in accordance with the invention has a low web tension, preferably less than about 50 N/m, at least in the region of the drying path 7, and a meander-like web path 36 with small radii of curvature, preferably less than about 200 mm, the web running along an always curved path, at least along the drying path, that is to say the path contains substantially no rectilinear path sections.

The web 4 separated from the press cylinder 22 or released by the pull roll 30 is, according to the invention, guided along the drying path with a reduced tensile stress. The reduction in the tensile stress can be carried out to such an extent that the tensile stress is just suitable to convey the separated or released web 4. The value of the tensile stress can also assume a minimal value suitable for conveying the separated or released web 4.

As compared with conventional 500 N/m tensile stress, the value can be reduced, for example, to about 50 N/m or even less. Given such low tensile stresses, the web 4 can form a meander-like web path 36 whose radii of curvature are small, preferably can be less than about 200 mm.

Figure 2:
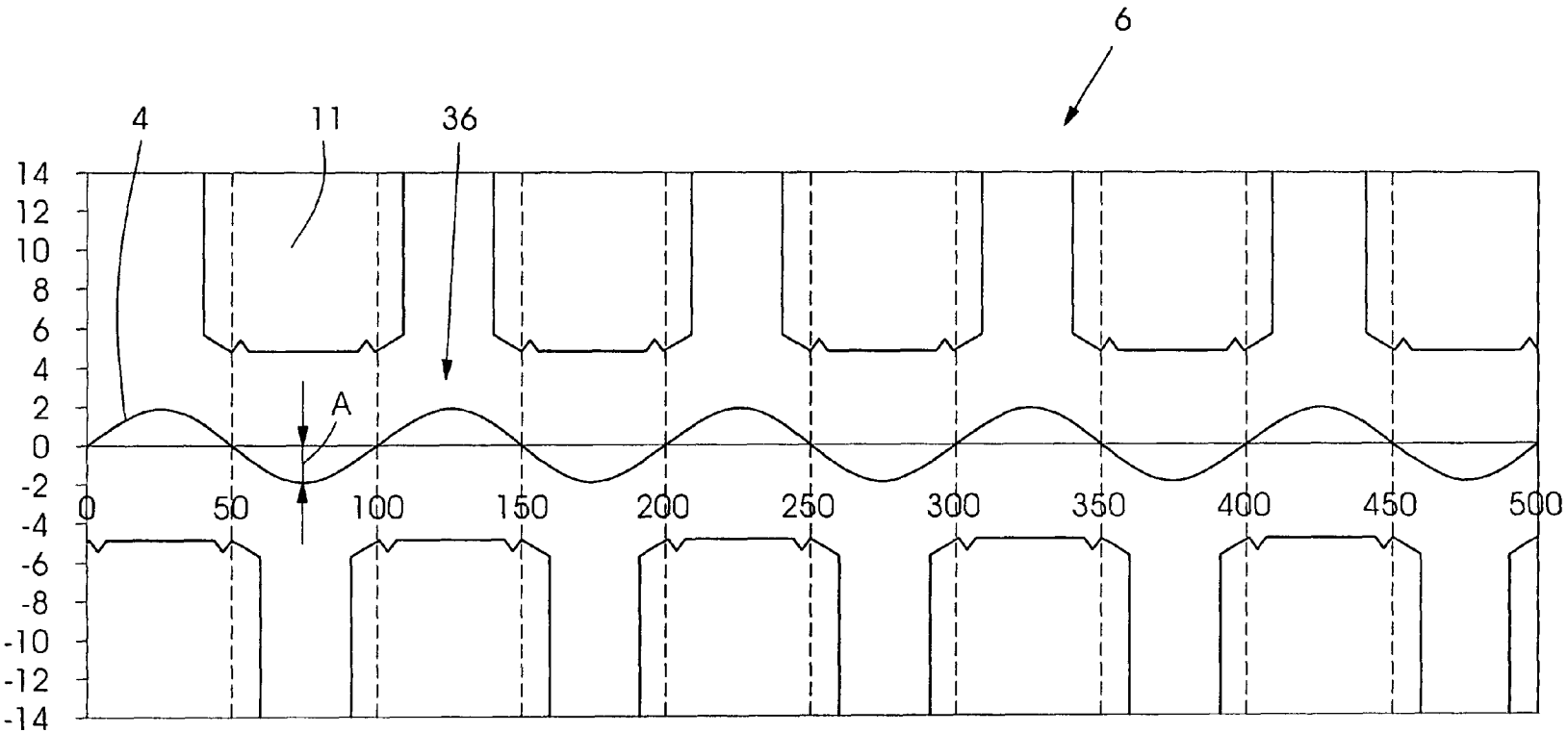
FIG. 2 is a diagrammatic, side-elevational view of the meander-like web path in the dryer.

FIG. 2 shows a schematic side view of the meander-like web path 36 in the dryer 6, a statement of dimensions in mm being illustrated both in the horizontal direction and in the vertical direction. In this case, the vertical direction is illustrated enlarged, in order to bring out the meander-like, preferably substantially sinusoidal, web path 36 clearly.

The nozzle bars 11 are disposed on both sides of the web 4, spaced apart from one another and offset in the horizontal direction. As a result of acting on the web 4 with blown air, the web follows a meander-like path 36. At a given intensity of the blown air, the deflection A of the web 4 can be increased by reducing the tensile stress. In the process, the curvature of the web is enlarged and the radius of curvature is reduced.

Instead of a hot air float dryer, use can also be made of a UV dryer with floating guidance of the web.

Furthermore, a dryer with heated rolls can also be used. In this case, the web 4 can be guided along the rolls floating, for example on an air pad. However, it is also possible for the web 4 to make contact with the rolls in order to take up heat. In this case, care must be taken that no build-up of ink on the rolls occurs, for example by the use of ink-repellent roll surfaces.

Furthermore, use can also be made of a dryer with rods similar to the turner rods normally used in the folder superstructure, that is to say the rods can be provided with holes for blowing out air. This air is used both for carrying and for drying the web 4.

According to the invention, in machines with UV dryers, roll dryers and rod dryers, the web 4 is also separated from a last press cylinder 22 and the web is acted on with a tensile stress by a reduced-speed pull roll 15. In this case, the web 4 advantageously forms a meander-like web path and has a reduced web tension, so that fluting waves can be prevented or minimized. The meander-like web path can extend freely in space in the UV dryer, in a comparable way in the hot air float dryer, or in the roll or rod dryer, can extend formed like a meander along appropriately arranged rolls or rods.

Furthermore, the invention can also be used in toner processing machines, for example in web processing electrophotographic copiers.

I claim:

1. A web-fed rotary printing press, comprising:

at least one press cylinder for printing a paper web conveyed at a controllable first tensile stress;

a dryer disposed downstream of said press cylinder, said dryer including a plurality of nozzle bars disposed on both sides of the web guiding the web along a meander-like path, the nozzle bars being spaced apart and offset from one another;

a pull roll disposed downstream of said dryer for conveying the paper web along said meander-like path under a second tensile stress;

a first apparatus disposed downstream of said press cylinder and upstream of said dryer for separating the paper web from said press cylinder during a normal printing operation, said separating of the paper web from said press cylinder being decoupled from the conveying of said paper web along said path;

a second apparatus for driving said pull roll at a controllable rotational speed which sets said second tensile stress; and a controller coupled to said at least one press cylinder and to said second apparatus, said controller setting said first tensile stress and said second tensile stress such that said second tensile stress is less than said first tensile stress.

2. The web-fed rotary printing press according to claim 1, wherein said controller sets said first tensile stress and said second tensile stress such that said second tensile stress is 10% or less than said first tensile stress.

3. The web-fed rotary printing press according to claim 1, wherein said first apparatus for separating the paper web from said press cylinder separates the paper web from said press cylinder without contact.

4. The web-fed rotary printing press according to claim 3, wherein said first apparatus has at least one element selected from the group consisting of blowing elements and ultrasound elements.

5. The web-fed rotary printing press according to claim 1, wherein the web-fed rotary printing press is a web-fed rotary offset press.

6. The web-fed rotary printing press according to claim 1, wherein said first apparatus for separating the paper web from said press cylinder is configured or coated in an ink-repellent manner, at least in some sections.

7. A web-fed rotary printing press, comprising:

at least one press cylinder for printing a paper web conveyed under a controllable first tensile stress;

a dryer disposed downstream of said press cylinder, said dryer including a plurality of nozzle bars disposed on both sides of the web guiding the web along a meander-like path, the nozzle bars being spaced apart and offset from one another;

a first pull roll disposed downstream of said dryer to convey the paper web along the meander-like path under a second tensile stress;

a second pull roll, which is disposed downstream of said press cylinder and upstream of said dryer, for releasing the paper web during a normal printing operation and for controllably setting a third tensile stress on the paper web between the at least one press cylinder and said second pull roll;

an apparatus for driving said first pull roll at a controllable rotational speed which sets said second tensile stress; and a controller coupled to said at least one press cylinder and to said apparatus, said controller setting said first tensile stress and said second tensile stress such that said second tensile stress is less than said first tensile stress.

8. The web-fed rotary printing press according to claim 7, wherein said controller sets said first tensile stress and said second tensile stress such that said second tensile stress is 10% or less than said first tensile stress.

9. The web-fed rotary printing press according to claim 7, wherein said second pull roll is configured or coated in an ink-repellent manner, at least in some sections.

10. The web-fed rotary printing press according to claim 7, wherein said first pull roll is a cooling roll.

11. The web-fed rotary printing press according to claim 7, wherein said first and second pull rolls are in each case constructed as a driven, rotating element.

12. The web-fed rotary printing press according to claim 7, wherein said first pull roll and said press cylinder are in each case constructed as a driven, rotating element.

13. The web-fed rotary printing press according to claim 7, wherein the web-fed rotary printing press is a web-fed rotary offset press.

14. A method for treating a printing material web in a printing material web in a web-fed rotary printing press, which further comprises:

feeding a paper web to a press cylinder under a first controllable tensile stress;

printing on the paper web using the press cylinder;

conveying the paper web along a drying path under a second controllable tensile stress of the paper web which is controllably set to be equal to or less than 10% of the first controllable tensile stress, the drying path being established by a plurality of nozzle bars disposed on both sides of the web guiding the web along a meander-like path, the nozzle bars being spaced apart and offset from one another; and separating the paper web from the press cylinder during a normal printing operation, the separating of each paper web from the press cylinder being decoupled from the conveying of the paper web along the path.

15. The method according to claim 14, which further comprises setting the second controllable tensile stress to a value suitable for conveying the paper web after separation from the press cylinder.

16. The method according to claim 14, which further comprises conveying the paper web along the drying path composed of path parts which follow one another and are oppositely curved.

17. The method according to claim 14, which further comprises controlling the second controllable tensile stress such that the drying path is composed of path parts which follow one another and are oppositely curved.

18. The method according to claim 14, which further comprises controlling the second controllable tensile stress such that the drying path has a radii of curvature following one another of in each case less than 200 mm.

19. The method according to claim 14, which further comprises increasing a temperature of the paper web along the drying path.

20. The method according to claim 14, which further comprises controlling the second controllable tensile stress such that the drying path is substantially sinusoidal.

21. A web-fed rotary printing press, comprising:

at least one press cylinder for printing a paper web conveyed under a controllable first tensile stress;

a dryer disposed downstream of said press cylinder, said dryer including a plurality of nozzle bars disposed on both sides of the web guiding the web along a meander-like path, the nozzle bars being spaced apart and offset from one another;

a first pull roll disposed downstream of said dryer to convey the paper web along the path under a controllable second tensile stress;

a second pull roll disposed downstream of said press cylinder and upstream of said dryer for releasing the paper web during a normal printing operation and for controllably setting a third tensile stress on the paper web between the at least one press cylinder and said second pull roll;

an apparatus for driving said first pull roll at a controllable rotational speed to set said second tensile stress; and a controller coupled to said apparatus and to said second pull roll for controlling said second tensile stress and said third tensile stress such that said second tensile stress is less than said third tensile stress.

22. The web-fed rotary printing press of claim 21, wherein the controller controls said second tensile stress and said third tensile stress such that said second tensile stress is 10% or less than said third tensile stress.

23. The web-fed rotary printing press of claim 22, wherein said controller is also coupled to at least one press cylinder for controlling said first tensile stress.

24. The web-fed rotary printing press of claim 23, wherein said controller sets said third tensile stress to be greater than said first tensile stress.

* * * * *